US006645686B1

(12) United States Patent
Fu et al.

(10) Patent No.: US 6,645,686 B1
(45) Date of Patent: Nov. 11, 2003

(54) ELECTROPHOTOGRAPHIC IMAGING MEMBERS

(75) Inventors: Min-Hong Fu, Webster, NY (US); Colleen A. Helbig, Penfield, NY (US); Kent J. Evans, Lima, NY (US); Kathleen M. Carmichael, Williamson, NY (US); June E. Schneider, Honeoye Falls, NY (US); David M. Skinner, Rochester, NY (US); Alfred H. Willnow, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/205,127

(22) Filed: Jul. 23, 2002

(51) Int. Cl.[7] ..... G03G 5/047
(52) U.S. Cl. ..... 430/58.4; 430/58.6; 430/58.65
(58) Field of Search ..... 430/58.05, 58.4, 430/58.6, 58.65

(56) References Cited

U.S. PATENT DOCUMENTS

| | | | | |
|---|---|---|---|---|
| 4,047,948 | A | 9/1977 | Hovgan | 96/1.5 R |
| 4,197,119 | A | 4/1980 | Sadamatsu et al. | 430/55 |
| 4,265,990 | A | 5/1981 | Stolka et al. | 430/59 |
| 4,346,158 | A | 8/1982 | Pai et al. | 430/59 |
| 4,388,392 | A | 6/1983 | Kato et al. | 430/58 |
| 4,801,517 | A | 1/1989 | Frechet et al. | 430/59 |
| 4,806,443 | A | 2/1989 | Yanus et al. | 430/56 |
| 4,818,650 | A | 4/1989 | Limburg et al. | 430/56 |
| 4,959,288 | A | 9/1990 | Ong et al. | 430/59 |
| 5,055,366 | A | 10/1991 | Yu et al. | 430/58 |
| 5,122,429 | A | 6/1992 | Sundararajan et al. | 430/58 |
| 5,202,408 | A | 4/1993 | Yanus et al. | 528/203 |
| 5,262,512 | A | 11/1993 | Yanus et al. | 528/181 |
| 5,413,886 | A | 5/1995 | Pai et al. | 430/58 |
| 5,420,226 | A | 5/1995 | Hamer et al. | 528/201 |
| 5,626,998 | A | 5/1997 | Grabowski et al. | 430/67 |
| 6,136,442 | A | 10/2000 | Wong | 428/412 |
| 6,214,514 | B1 | 4/2001 | Evans et al. | 430/133 |
| 6,265,050 | B1 | 7/2001 | Wong et al. | 428/209 |
| 6,337,166 | B1 * | 1/2002 | Chambers et al. | 430/59.6 |
| 6,372,396 | B1 | 4/2002 | Yu et al. | 430/56 |
| 6,383,699 | B1 * | 5/2002 | Yuh et al. | 430/65 |

FOREIGN PATENT DOCUMENTS

| | | |
|---|---|---|
| EP | 034 425 | 8/1981 |

* cited by examiner

*Primary Examiner*—John Goodrow
(74) *Attorney, Agent, or Firm*—E. O. Palazzo

(57) ABSTRACT

An electrophotographic imaging member comprises a substrate, a charge generating layer, and a charge transport layer. The charge transport layer comprises a binder and charge transport molecules, wherein the binder eliminates or minimizes crystallization of the charge transport molecules. Optionally, an electrophotographic imaging member comprises a substrate and a single charge generating and charge transport layer. The single charge generating and charge transport layer comprises a binder, charge generating molecules and charge transport molecules, wherein the binder eliminates or minimizes crystallization of the charge transport molecules. Specific binders are PCZ-800, a PCZ-500, or a PCZ-400 polycarbonate resin.

17 Claims, No Drawings

ELECTROPHOTOGRAPHIC IMAGING MEMBERS

FIELD

The present invention relates generally to electrophotographic imaging members. The invention relates particularly to electrophotographic imaging members in which crystallization of charge transport molecules is eliminated or minimized.

BACKGROUND

Typical electrophotographic imaging members (for example, photoreceptors) comprise a photoconductive layer comprising a single layer or composite layers. One type of composite photoconductive layer used in xerography is illustrated, for example, in U.S. Pat. No. 4,265,990 which describes a photosensitive member having at least two electrically operative layers. The disclosure of this patent is incorporated herein in its entirety. One layer comprises a photoconductive layer which is capable of photogenerating holes and injecting the photogenerated holes into a contiguous charge transport layer. Generally, where the two electrically operative layers are supported on a conductive layer the photogenerating layer is sandwiched between the contiguous charge transport layer and the supporting conductive layer, the outer surface of the charge transport layer is normally charged with a uniform electrostatic charge. The photosensitive member is then exposed to a pattern of activating electromagnetic radiation such as light, which selectively dissipates the charge in illuminated areas of the photosensitive member while leaving behind an electrostatic latent image in the non-illuminated areas. This electrostatic latent image may then be developed to form a visible image by depositing finely divided electrostatic toner particles on the surface of the photosensitive member. The resulting visible toner image can be transferred to a suitable receiving material such as paper. This imaging process may be repeated many times with reusable photosensitive members.

As more advanced, complex, highly sophisticated, electrophotographic copiers, duplicators and printers were developed, greater demands were placed on the photoreceptor to meet stringent requirements for the production of high quality images.

One type of multi-layered photoreceptor that has been employed as a belt in electrophotographic imaging systems comprises a substrate, a conductive layer, a charge blocking layer a charge generating layer, and a charge transport layer. The charge transport layer often comprises an activating small molecule dispersed or dissolved in a polymeric film forming binder. Generally, the polymeric film forming binder in the transport layer is electrically inactive by itself and becomes electrically active when it contains the activating molecule. The expression "electrically active" means that the material is capable of supporting the injection of photogenerated charge carriers from the material in the charge generating layer and is capable of allowing the transport of these charge carriers through the electrically active layer in order to discharge a surface charge on the active layer. The multi-layered type of photoreceptor may also comprise additional layers such as an anti-curl backing layer, required when layers possess different coefficient of thermal expansion values, an adhesive layer, and an overcoating layer. Commercial high quality photoreceptors have been produced which utilize an anti-curl coating. Although excellent toner images may be obtained with multi-layered belt photoreceptors that are developed with dry developer powder (toner), it has been found that these same photoreceptors become unstable when employed with liquid development systems. These photoreceptors suffer from cracking, crazing, crystallization of active compounds, phase separation of activating compounds and extraction of activating compounds caused by contact with the organic carrier fluid, isoparaffinic hydrocarbons e.g. ISOPAR™, commonly employed in liquid developer inks which, in turn, markedly degrade the mechanical integrity and electrical properties of the photoreceptor. More specifically, the organic carrier fluid of a liquid developer tends to leach out activating small molecules, such as the arylamine containing compounds typically used in the charge transport layers. Representative of this class of materials are: N,N'-diphenyl-N,N'-bis(3-methylphenyl)-[1,1'-biphenyl]-4,4'-diamine; bis-(4-diethylamino-2-methylphenyl)-phenylmethane; 2,5-bis-(4'-dimethylaminophenyl)-1,3,4-oxadiazole; 1-phenyl-3-(4'-diethylaminostyryl)-5-(4"-diethylaminophenyl)pyrazoline; 1,1-bis-(4-(di-N,N'-p-methylphenyl)-aminophenyl)-cyclohexane; 4-diethylaminobenzaldehyde-1,1-diphenylhydrazone; 1,1-diphenyl-2(p-N,N-diphenylamino phenyl)-ethylene; N-ethylcarbazole-3-carboxaldehyde-1-methyl-1-phenylhydrazone. In embodiment, the transport layer for typical photoreceptors, such as those described in U.S. Pats. Nos. 6,190,818 and 6,214,514, herein incorporated by reference, comprise mainly m-TBD (N,N'-diphenyl-N,N'-bis(3-methylphenyl)-[1,1'-biphenyl]-4,4'-diamine) transport molecules and MAKROLON™ (biphenyl A polycarbonate) binders. Other additives such as antioxidant IRGANOX™ have been added for lateral charge migration control. This formulation was chosen because m-TBD has superior hole transport characteristics and MAKROLON™ are m-TBD compatible binders. Both the superior hole transport characteristics of the transport molecules and the compatibility of the binders are required for optimum photoreceptor functioning and manufacturing feasibility. A disadvantage of this specific transport layer formulation is that, as a result of using such a high concentration of m-TBD to provide optimum mobility in the transport layer, the m-TBD is more susceptible to crystallization. This has potential adverse effects on photoreceptor performance, such as photoreceptor sensitivity, stability, cracking, wear and other printable defects. Moreover, MAKROLON™ is in short supply and, therefore, other alternative binders are deemed necessary. New challenges for longer life photoreceptors and better print quality have made it necessary to continue improving photoreceptors.

Photoreceptors have been developed, such as those described in U.S. Pat. No. 5,055,366, which comprise a further protective overcoating layer that inhibits crystallization of the charge transport material.

Photoreceptors have been developed which comprise charge transfer complexes prepared with polymeric molecules. For example, charge transport complexes formed with polyvinyl carbazole are disclosed in U.S. Pat. Nos. 4,047,948, 4,346,158 and 4,388,392. Photoreceptors utilizing polyvinyl carbazole layers, as compared with current photoreceptor requirements, exhibit relatively poor xerographic performance in both electrical and mechanical properties. Polymeric arylamine molecules prepared from the condensation of di-secondary amine with a di-iodo aryl compound are disclosed in European patent publication 34,425, published Aug. 26, 1981 and issued May 16, 1984. Since these polymers are extremely brittle and form films which are very susceptible to physical damage, their use in a flexible belt configuration is precluded. Thus, in advanced imaging systems utilizing multi-layered belt photoreceptors exposed to liquid development systems, cracking and crazing have been encountered in critical charge transport layers during belt cycling. Cracks developing in charge transport layers during cycling can be manifested as print-out defects adversely affecting copy quality. Furthermore, cracks in the photoreceptor pick up toner particles which cannot be removed in the cleaning step and may be transferred to the background in subsequent prints. In addition, crack areas are subject to delamination when contacted with blade cleaning devices thus limiting the options in electrophotographic product design. It should also be noted that the presence of an anti-curl back coating will exacerbate the propagation of cracks in brittle polymers.

Recently photoreceptors having charge transport layers containing charge transporting arylamine polymers have been described in the patent literature, for example in U.S. Pat. Nos. 4,806,443, 4,806,443, 4,801,517, 4,818,650, 4,959,288, 5,202,408 and 5,262,512, the entire disclosures of these patents being incorporated herein by reference. These polymers tend to possess poor mechanical properties and are soft and non-robust.

Other photoreceptors having charge transport layers containing a charge transport molecule and a binder mixture comprising a polycarbonate and an elastomeric block copolymer have been described in U.S. Pat. No. 5,122,429, the entire disclosure of this patent being incorporated herein by reference.

It is apparent that there continues to be a need for improved electrophotographic imaging members that eliminates or minimizes crystallization of charge transport molecules without the need for an overcoat, polymeric mixtures incorporating an elastomeric block copolymer or subsequent polymerization of charge transport molecules to provide charge transporting polymers.

SUMMARY OF THE INVENTION

It is a feature of the present invention to provide a electrophotographic imaging member that comprises a binder that eliminates or minimizes crystallization of charge transport molecules.

It is another feature of the present invention to provide a multi-layer photoreceptor wherein the transport layer comprises a binder that eliminates or minimizes crystallization of charge transport molecules.

It is yet another feature of the present invention to provide a single layer photoreceptor wherein the single charge generating and charge transport layer comprises a binder that eliminates or minimizes crystallization of charge transport molecules.

In an embodiment of the present invention, there is provided an electrophotographic imaging member comprising a substrate, a charge generating layer, and a charge transport layer comprising charge transport molecules and a binder selected from the group consisting of polyesters, polyarylates, polyacrylates, polyethers, polysulfones and mixtures thereof, wherein the binder eliminates or minimizes crystallization of the charge transport molecules. In specific embodiments, the charge transport layer comprises from about 35 percent to about 50 percent by weight of at least one charge transport material, and about 50 percent to about 65 percent by weight of the binder.

In another embodiment of the present invention, there is provided an electrophotographic imaging member comprising a substrate, a charge generating layer, and a charge transport layer comprising charge transport molecules and a binder which eliminates or minimizes crystallization of the charge transport molecules, wherein the binder is other than a mixture of a polycarbonate and an elastomeric block copolymer comprised of an amorphous poly(b-styrene-b-butadiene-b-styrene).

In yet another embodiment of the present invention, there is provided a substrate and a single charge generating and charge transport layer comprising a binder, charge generating molecules and charge transport molecules, wherein the binder eliminates or minimizes crystallization of the charge transport molecules. In specific embodiments, the charge transport layer comprises from about 45 percent to about 49 percent by weight of at least one charge transport material, about 47 percent to about 50 percent by weight of the binder and about 1 to about 5 percent by weight of at least one charge generating compound.

Typically, the binder is an inactive polymeric film forming binder selected from the group consisting of polyesters, polyarylates, polyacrylates, polyethers, polysulfones and mixtures thereof. In specific embodiments, the inactive polymeric film forming binder has a molecular weight that ranges from about 20,000 to about 280,000. More specifically, the inactive polymeric film forming binder is a bisphenol Z polycarbonate (PCZ), in particular, selected from the group consisting of a PCZ-800, a PCZ-500, a PCZ-400 polycarbonate resin and mixtures thereof.

Typically, the charge transport molecules are a non-polymeric small molecule charge transport material which is soluble or dispersible on a molecular scale in the binder. In embodiments, the charge transport material is selected from the group consisting of diamines, aromatic amines, pyrazolines, substituted fluorenes, oxadiazoles, hydrazones, carbazole phenyl hydrazones, tri-substituted methanes and mixtures thereof, in particular, the charge transport material is selected from the group consisting of N,N'-diphenyl-N,N'-bis(alkylphenyl)-[1,1'-biphenyl]-4,4'-diamine, wherein the alkyl contains from about 1 to 20 carbons; N,N,N',N'-tetraphenyl-[2,2'-dimethyl-1,1'-biphenyl]-4,4'-diamine; N,N,N',N'-tetra(4-methylphenyl)-[2,2'-dimethyl-1,1'-biphenyl]-4,4'-diamine; N,N'-diphenyl-N,N'-bis(4-methylphenyl)[2,2'-dimethyl-1,1'-biphenyl]-4,4'-diamine; N,N'-diphenyl-N,N'-bis(2-methylphenyl)-[2,2'-dimethyl-1,1'-biphenyl]-4,4'-diamine; N,N'-diphenyl-N,N'-bis(3-methylphenyl)-[2,2'-dimethyl-1,1'-biphenyl]-4,4'-diamine; N,N'-diphenyl-N,N'-bis(3-methylphenyl)-pyrenyl-1,6-diamine; N,N'-bis-(3-methoxyphenyl)-N,N'-diphenylbiphenyl-4,4'-diamine (HCT-305 from Hodagaya); bis(4-diethylamine-2-methylphenyl)phenylmethane; 4'-4"-bis(diethylamino)-2',2"-dimethyltriphenylmethane; N,N'-diphenyl-N,N'-bis(3-chlorophenyl)-[1,1'-biphenyl]-4,4'-diamine; N,N'-diphenyl-N,N'-bis(4-chlorophenyl)-[1,1'-biphenyl]-4,4'-diamine, 1-[lepidyl-(2)]-3-(p-diethylaminophenyl)-5-(p-diethylaminophenyl) pyrazoline; 1-[quinolyl-(2)]-3-(p-diethylaminophenyl)-5-(p-diethylaminophenyl) pyrazoline; 1-[pyridyl-(2)]-3-(p-diethylaminostyryl)-5-(p-diethylaminophenyl) pyrazoline; 1-[6-methoxypyridyl-(2)]-3-(p-diethylaminostyryl)-5-(p-diethylaminophenyl) pyrazoline; 1-phenyl-3-[p-dimethylaminostyryl]-5-(p-dimethylaminostyryl) pyrazoline; 1-phenyl-3-[p-diethylaminostyryl]-5-(p-diethylaminostyryl) pyrazoline; 9-(4'-dimethylaminobenzylidene)fluorene; 9-(4'-methoxybenzylidene)fluorene; 9-(2'4'-dimethoxybenzylidene)fluorene; 2-nitro-9-benzylidene-fluorene; 2-nitro-9-(4'-diethylaminobenzylidene)fluorene; 2,5-bis(4-diethylaminophenyl)-1,3,4-oxadiazole; pyrazoline; imidazole; triazole; p-diethylaminobenzaldehyde- (diphenylhydrazone); o-ethoxy-p-diethylaminobenzaldehyde-(diphenylhydrazone); o-methyl-p-diethylaminobenzaldehyde-(diphenylhydrazone); o-methyl-p-dimethylaminobenzaldehyde-(diphenylhydrazone); p-dipropylaminobenzaldehyde-(diphenylhydrazone); p-diethylaminobenzaldehyde-(benzylphenylhydrazone); p-dibutylaminobenzaldehyde-(diphenylhydrazone); p-dimethylaminobenzaldehyde-(diphenylhydrazone); 1-naphthalenecarbaldehyde 1-methyl-1-phenylhydrazone; 1-naphthalenecarbaldehyde 1,1-phenylhydrazone; 4-methoxynaphthlene-1-carbaldehyde 1-methyl-1-phenylhydrazone; 9-methylcarbazole-3-carbaldehyde-1,1-diphenylhydrazone; 9-ethylcarbazole-3-carbaldehyde-1-methyl-1-phenylhydrazone; 9-ethylcarbazole-3-carbaldehyde-1-ethyl-1-phenylhydrazone; 9-ethylcarbazole-3-carbaldehyde-1-ethyl-1-benzyl-1-phenylhydrazone; 9-ethylcarbazole-3-carbaldehyde-1,1-diphenylhydrazone and mixtures thereof.

More specifically, the charge transport material is N,N'-diphenyl-N,N'-bis(alkylphenyl)-[1,1'-biphenyl]-4,4'-diamine selected from the group consisting of N,N'-diphenyl-N,N'-bis(3-methylphenyl)-[1,1'-biphenyl]-4,4'-diamine; N,N'-diphenyl-N,N'-bis(4-methylphenyl)-[1,1'-biphenyl]-4,4'-diamine; N,N'-diphenyl-N,N'-bis(2-methylphenyl)-[1,1'-biphenyl]-4,4'-diamine; N,N'-diphenyl-N,N'-bis(3-ethylphenyl)-[1,1'-biphenyl]-4,4'-diamine; N,N'-diphenyl-N,N'-bis(4-ethylphenyl)-[1,1'-biphenyl]-4,4'-diamine; N,N'-diphenyl-N,N'-bis(4-n-butylphenyl)-[1,1'-biphenyl]-4,4'-diamine; N,N'-diphenyl-N,N'-bis(phenylmethyl)-[1,1'-biphenyl]-4,4'-diamine; alkyl-bis(N,N-dialkylaminoaryl)methane; cycloalkyl-bis(N,N-dialkylaminoaryl)methane; cycloalkenyl-bis(N,N-dialkylaminoaryl)methane and mixtures thereof.

EMBODIMENTS

The present invention may be utilized with single layer photoreceptors or multi-layer photoreceptors. Generally, multi-layer photoreceptors comprise a supporting substrate having an electrically conductive surface layer, an optional charge blocking layer on the electrically conductive surface, an optional adhesive layer, a charge generating layer on the blocking layer and a transport layer on the charge generating layer. Examples of such multi-layer photoreceptors are described in U.S. Pat. Nos. 6,197,464, 6,242,144, and 6,207,334, which are incorporated herein by reference. Typically, single layer photoreceptors comprise a supporting substrate, having an electrically conductive surface layer, and a single charge generating and transport layer. Optionally, a charge blocking layer on the electrically conductive surface and/or an adhesive layer may be used. Examples of such single layer photoreceptors are described in U.S. Pat. Nos. 5,336,577 and 4,415,640, which are incorporated herein by reference.

The supporting substrate may be opaque or substantially transparent and may be fabricated from various materials having the requisite mechanical properties. The supporting substrate may comprise electrically non-conductive or conductive, inorganic or organic composition materials. The supporting substrate may be rigid or flexible and may have a number of different configurations such as, for example, a cylinder, sheet, a scroll, an endless flexible belt, or the like. In specific embodiments, the supporting substrate is in the form of an endless flexible belt and comprises a commercially available biaxially oriented polyester known as PET (polyethylene terephthalate) or PEN (polyethylene naphthalate) available from Dupont Teijin Films, or MELINE™ available from ICI. Exemplary electrically non-conducing materials known for this purpose include polyesters, polycarbonates, polyamides, polyurethanes, and the like.

The average thickness of the supporting substrate depends on numerous factors, including economic considerations. A flexible belt may be of substantial thickness, for example, over 200 micrometers, or have a minimum thickness less than 50 micrometers, provided there are no adverse affects on the final photoreceptor device. In one flexible belt embodiment, the average thickness of the support layer ranges from about 65 micrometers to about 150 micrometers, and specifically from about 75 micrometers to about 125 micrometers for optimum flexibility and minimum stretch when cycled around small diameter rollers, for example, 12 millimeter diameter rollers.

The electrically conductive surface layer may vary in average thickness over substantially wide ranges depending on the optical transparency and flexibility desired. Accordingly, when a flexible multi-layer photoreceptor is desired, the thickness of the electrically conductive surface layer may be from about 20 Angstrom units to about 750 Angstrom units, and more specifically from about 50 Angstrom units to about 200 Angstrom units for a specific combination of electrical conductivity, flexibility and light transmission. The electrically conductive surface layer may be a metal layer formed, for example, on the support layer by a coating technique, such as a vacuum deposition. Typical metals employed for this purpose include aluminum, zirconium, niobium, tantalum, vanadium and hafnium, titanium, Is nickel, stainless steel, chromium, tungsten, molybdenum, and the like. Useful metal alloys may contain two or more metals such as zirconium, niobium, tantalum, vanadium and hafnium, titanium, nickel, stainless steel, chromium, tungsten, molybdenum, and the like. The electrically conductive surface layer need not be limited to metals. Other examples of conductive layers may be combinations of materials such as conductive indium-tin oxide as a transparent layer for light having a wavelength from about 4000 Angstroms and about 7000 Angstroms or a conductive carbon black dispersed in a plastic binder as an opaque conductive layer.

After deposition of the electrically conductive surface layer, an optional blocking layer may be applied thereto. Generally, electron blocking layers for positively charged photoreceptors allow holes from the imaging surface of the photoreceptor to migrate toward the conductive layer. The blocking layer may be organic or inorganic and may be deposited by any suitable technique. For example, if the blocking layer is soluble in a solvent, it may be applied as a solution and the solvent can subsequently be removed by any conventional method such as by drying. Typical blocking layers include polyvinylbutyral, organosilanes, epoxy resins, polyesters, polyamides, polyurethanes, pyroxyline vinylidene chloride resin, silicone resins, fluorocarbon resins and the like containing an organo-metallic salt. Other blocking layer materials include nitrogen—containing siloxanes or nitrogen—containing titanium compounds such as trimethoxysilyl propylene diamine, hydrolyzed trimethoxysilylpropylethylene diamine, N-beta-(aminoethyl)-gamma-aminopropyltrimethoxy silane, isopropyl-4-aminobenzene sulfonyl, di(dodecylbenzene sulfonyl) titanate, isopropyl-di(4-aminobenzoyl)isostearoyl titanate, isopropyl-tri(N-ethylamino-ethylamino) titanate, isopropyl trianthranil titanate, isopropyl-tri-(N,N-dimethylethylamino) titanate, titanium-4-amino benzene sulfonatoxyacetate, titanium 4-aminobenzoate-isostearate-oxyacetate, $[H_2N(CH_2)_4]\ CH_3\ Si(OCH_3)_2$ ((gamma-aminobutyl)methyl diethoxysilane), and $[H_2N(CH_2)_3]$ $CH_3$ $Si(OCH_3)_2$ ((gamma-aminopropyl) methyldiethoxy silane), as disclosed in U.S. Pat. Nos. 4,291,110, 4,338,387, 4,286,033 and 4,291,110, the entire disclosures of these patents being incorporated herein by reference. The blocking layer may comprise a reaction product between a hydrolyzed silane and a thin metal oxide layer formed on the outer surface of an oxidizable metal electrically conductive surface.

The blocking layer is in embodiments continuous and usually has an average thickness of less than about 5000 Angstrom units. A blocking layer of from about 50 Angstrom units and about 3000 Angstrom units is used in specific embodiments because charge neutralization after light exposure of the photoreceptor is facilitated and improved electrical performance is achieved. The blocking layer may be applied by a suitable technique such as spraying, dip coating, draw bar coating, gravure coating, silk screening, air knife coating, reverse roll coating, vacuum deposition, chemical treatment and the like. For convenience in obtaining thin layers, the blocking layers are in embodiments applied in the form of a dilute solution, with the solvent being removed after deposition of the coating by techniques such as by vacuum, heating and the like. Generally, a weight ratio of blocking layer material and solvent of from about 0.05:100 and about 0.5:100 is satisfactory for spray coating. A typical siloxane coating is described in U.S. Pat. No. 4,464,450, the entire disclosure thereof being incorporated herein by reference.

If desired, an optional adhesive layer may be applied to the hole blocking layer or conductive surface. Typical adhesive layers include a polyester resin such as VITEL PE-100™, VITEL PE-200™, VITEL PE-200D™, and VITEL PE-222™, all from Bostik, ARDEL POLYARYLATE (U-100) from Yuniehkia, 49,000 polyester from Rohm Hass, polyvinyl butyral, and the like. When an adhesive layer is employed, it should be continuous and, preferably, have an average dry thickness from about 200 Angstrom units and about 900 Angstrom units and more specifically from about 400 Angstrom units and about 700 Angstrom units. Any suitable solvent or solvent mixtures may be employed to form a coating solution of the adhesive layer material. Typical solvents include tetrahydrofuran, toluene, methylene chloride, cyclohexanone, and mixtures thereof. Generally, for example, to achieve a continuous adhesive layer dry thickness of about 900 Angstroms or less by gravure coating techniques, the specific solids concentration is about 2 percent to about 5 percent by weight based on the total weight of the coating mixture of resin and solvent. However, any suitable technique may be utilized to mix and thereafter apply the adhesive layer coating mixture to the charge blocking layer. Typical application techniques include spraying, dip coating, roll coating, wire wound rod coating, and the like. Also, any suitable extrusion coating technique may be employed to form the charge transport layer coatings. Typical extrusion techniques include, for example, slot coating, slide coating, curtain coating, and the like. Drying of the deposited coating may be effected by a suitable technique such as oven drying, infrared radiation drying, air drying and the like.

In the multi-layer photoreceptor, a charge generating layer is applied to the blocking layer, or adhesive layer if either are employed, to which a charge transport layer may be applied thereto. In the single layer photoreceptor, a single charge generating and charge transport layer is applied to the blocking layer, or adhesive layer if either are employed. Examples of charge generating layers/materials include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine described in U.S. Pat. No. 3,357,989, metal phthalocyanines such as hydroxygallium phthalocyanine described in U.S. Pat. No. 5,725,985, vanadyl phthalocyanine, titanyl phthalocyanines and copper phthalocyanine, quinacridones available from DuPont under the trade name Monastral Red™, Monastral Violet™ and Monastral Red Y™. Vat Orange 1™ and Vat Orange 3™ are trade names for dibromoanthrone pigments, benzimidazole perylene, substituted 3,4-diaminotriazines disclosed in U.S. Pat. No. 3,442,781, polynuclear aromatic quinones available from Allied Chemical Corporation under the tradename Indofast Double Scarlet™, Indofast Violet Lake B™. Indofast Brilliant Scarlet™ and Indofast Orange™, and the like dispersed in a film forming polymeric binder. Selenium, selenium alloy, benzimidazole perylene, and the like and mixtures thereof, may be formed. Benzimidazole perylene compositions are well known and described, for example, in U.S. Pat. No. 4,587,189. Other suitable charge generating materials known in the art may also be utilized, if desired. Charge generating binder layers/materials comprising particles or layers including a photoconductive material such as hydroxygallium phthalocyanine, vanadyl phthalocyanine, titanyl phthalocyanines, metal-free phthalocyanine, benzimidazole perylene, amorphous selenium, trigonal selenium, selenium alloys such as selenium-tellurium, selenium-tellurium-arsenic, selenium arsenide and the like, and mixtures thereof, are especially in embodiments because of their sensitivity to white light. Vanadyl phthalocyanine, titanyl phthalocyanines, metal free phthalocyanine and tellurium alloys are also in embodiments because these materials provide the additional benefit of being sensitive to infra-red light.

The active charge transport layer/material may comprise any suitable non-polymeric small molecule charge transport material capable of supporting the injection of photogenerated holes and electrons from the charge generating layer/material and allowing the transport of these holes or electrons through the layer to selectively discharge the surface charge. The active charge transport layer/material not only serves to transport holes or electrons, but, in the multi-layer photoreceptor, it may also protect the charge generator layer from abrasion or chemical attack and therefor extend the operating life of the photoreceptor imaging member. Thus, the active charge transport layer/material is a substantially non-photoconductive material which supports the injection of photogenerated holes or electrons from the generation layer/material.

Any suitable soluble non-polymeric small molecule transport material may be employed in the charge transport layer coating mixture or in the single charge generating and charge transport. This small molecule transport material is dispersed in an electrically inactive polymeric film forming binder to make the binder electrically active. In the multi-layer photoreceptors, these non-polymeric activating materials are added to a film forming polymeric binder which is incapable of supporting the injection of photogenerated holes from the generation material and incapable of allowing the transport of these holes therethrough. This will convert the electrically inactive polymeric binder to a binder capable of supporting the injection of photogenerated holes from the generation material and capable of allowing the transport of these holes through the active layer in order to discharge the surface charge on the active layer.

Any suitable non-polymeric small molecule charge transport material which is soluble or dispersible on a molecular scale in a film forming binder may be utilized in the continuous phase of the charge transporting layer or in the single charge generating and charge transport layer. The charge transport molecule should be capable of transporting charge carriers injected by the charge injection enabling particles in an applied electric field. The charge transport molecules may be hole transport molecules or electron transport molecules. Typical charge transporting materials include the following:

Diamine transport molecules of the types described in U.S. Pat. Nos. 4,306,008, 4,304,829, 4,233,384, 4,115,116, 4,299,897, 4,265,990 and 4,081,274. Typical diamine transport molecules include N,N'-diphenyl-N,N'-bis(alkylphenyl)-[1,1'-biphenyl]-4,4'-diamine wherein the alkyl contains, for example, from about 1 to 20 carbons such as the alkyl is methyl, ethyl, propyl, n-butyl, etc. such as N,N'-diphenyl-N,N'-bis(3-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-(chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phemphenyl)-[1,1'-biphenyl]-4,4'-diamine, N,N,N',N'-tetraphenyl-[2,2'-dimethyl-1,1'-biphenyl]-4,4'-diamine, N,N,N', N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, N,N'-bis-(3-methoxyphenyl-N,N'-diphenylbiphenyl-4,4'-diamine (HCT-305 from Hodagaya) and the like.

Pyrazoline transport molecules as disclosed in U.S. Pat. Nos. 4,315,982, 4,278,746, 3,837,851. Typical pyrazoline transport molecules include 1-[lepidyl-(2)]-3-(p-diethylaminophenyl)-5-(p-diethylaminophenyl) pyrazoline, 1-[quinolyl-(2)]-3-(p-diethylaminophenyl)-5-(p-diethylaminophenyl) pyrazoline, 1-[pyridyl-(2)]-3-(p-diethylaminostyryl)-5-(p-diethylaminophenyl) pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl) pyrazoline, 1-phenyl-3-[p-diethylaminostyryl]-5-(p-diethylaminostyryl) pyrazoline, and the like.

Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2'4'-dimethoxybenzylidene)fluorene, 2-nitro-9-benzylidene-fluorene, 2-nitro-9-(4'-diethylaminobenzylidene)fluorene and the like.

Oxadiazole transport molecules such as 2,5-bis(4-diethylaminophenyl)-1,3,4-oxadiazole, pyrazoline, imidazole, triazole, and others described in German Pat. Nos. 1,058,836, 1,060,260 and 1,120,875 and U.S. Pat. No. 3,895,944.

Hydrazone including, for example, p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example in U.S. Pat. Nos. 4,385,106, 4,338,388, 4,387,147, 4,399,208, 4,399,207.

Still another charge transport molecule is a carbazole phenyl hydrazone. Typical examples of carbazole phenyl hydrazone transport molecules include 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. 4,256,821. Similar hydrazone transport molecules are described, for example, in U.S. Pat. No. 4,297,426.

Tri-substituted methanes such as alkyl-bis(N,N'-dialkylaminoaryl)methane, cycloalkyl-bis(N,N-dialkylaminoaryl)methane, and cycloalkenyl-bis(N,N-dialkylaminoaryl)methane as described, for example, in U.S. Pat. No. 3,820,989.

A specific charge transport layer composition employed to fabricate the charge transport layer coatings of a multi-layer photoreceptor of this invention specifically comprises from about 35 percent to about 50 percent by weight of at least one charge transporting compound, and about 50 percent to about 65 percent by weight of a polymeric film forming binder in which the transporting compound is soluble and will eliminate or minimize crystallization of the compound. The charge transport layer forming solution of the multi-layer photoreceptor specifically comprises an aromatic amine compound as the small molecule transport compound.

A specific single charge generating and charge transport layer composition employed to fabricate the single layer coating of a single layer photoreceptor of this invention specifically comprises from about 45 percent to about 49 percent by weight of at least one charge transporting compound, from about 47 percent to about 50 percent by weight of a polymeric film forming binder in which the transporting compound is soluble and will eliminate or minimize crystallization of the compound, and specifically from about 1 percent to about 5 percent by weight of at least one charge generating compound, most specifically from about 3 percent by weight of at least one charge generating compound. The single charge generating and charge transport layer forming solution of the single layer photoreceptor comprises an aromatic amine compound as the transport compound.

Typical aromatic amine compounds include, for example, triphenylmethane, bis(4-diethylamine-2-methylphenyl) phenylmethane; 4'-4"-bis(diethylamino)-2',2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis (chlorophenyl)-[1,1'-biphenyl]-4,4'-diamine, 1,1'-biphenyl)-4,4'-diamine, and the like dispersed in an inactive polymeric film forming binder. Preferably, the aromatic amine is N,N'-diphenyl-N,N'-bis(3-methylphenyl)-[1,1'-biphenyl]-4,4'-diamine or N,N'-diphenyl-N,N'-bis(4-methylphenyl)-[1,1'-biphenyl]-4,4'-diamine.

In general, the suitable soluble inactive film forming binder eliminates or minimizes crystallization of the charge transport material and may be soluble, for example, in methylene chloride, chlorobenzene, tetrahydrofuran, toluene or another suitable solvent. In general, typical inactive polymeric film forming binders of the present invention include polyesters, polyarylates, polyacrylates, polyethers, polysulfones, and the like and mixtures thereof. Molecular weights can vary, for example, from about 20,000 to about 280,000. The specific inactive polymeric film forming binders are bisphenol Z polycarbonates (PCZ). More specifically, film forming polymers of the present invention are selected from the group consisting of PCZ-800, PCZ-500 and PCZ-400 polycarbonate resins and mixtures thereof.

Any suitable extrusion coating technique may be employed to form the charge transport layer coatings. Typical extrusion techniques include, for example, slot coating, slide coating, curtain coating, and the like.

The wet extruded charge transport layers should be continuous and sufficiently thick to provide the desired predetermined dried layer thicknesses. The maximum wet thickness of the deposited layer depends upon the solids concentration of the coating mixture being extruded. The expression "solids", as employed herein refers to the materials that are normally solids in the pure state at room temperature. In other words, solids are generally those materials in the coating solution that are not solvents. The relative proportion of solvent to solids in the coating solution varies depending upon the specific coating materials used, type of coating applicator selected, and relative speed between the applicator and the object being coated. Specifically, the solids concentration range is greater than about 13 percent total solids, based on the weight of the coating solution. The maximum solids concentration is determined by the combined solubility of the small molecule with film forming binder components in the solvent of choice. For example, in methylene chloride, this limit is in embodiments in the range of from about 15 percent to about 20 percent total solids. More specifically, it is in embodiments that the viscosity of the coating solution is from about 400 and about 1500 centipoises for satisfactory flowability and coatability. Highly dilute coating solutions of low viscosity can cause raindrop patterns to form.

Drying of each deposited charge transport layer coating may be effected by any suitable conventional technique such as oven drying, infrared radiation drying, air drying and the like. Specifically, the temperatures are such that the charge transport layer or single charge generating and charge transport layer have less than about 2 percent solvent remaining in the layer after drying. In particular, the temperatures and drying times are in embodiments from about 0.5 minutes at 54 degrees celsius; 0.5 minutes at 60 degrees celsius; 0.6 minutes at 107 degrees celsius and 1.3 minutes at 143 degrees celsius.

The following examples are being submitted to further illustrate various embodiments of the present invention. These examples are intended to be illustrative only and are not intended to limit the scope of the present invention.

EXAMPLE I

Control Formulation with m-TBD/MAKROLON/ Methylene Chloride

A coating solution was prepared by mixing 10 grams of MAKROLON™ 5705 (bisphenol A type polycarbonate of 4,4'-isopropylidene, commercially available from Farbenfabricken Bayer A.G.) and 10 grams of charge transport agent m-TBD (N,N'-bis(3-methylphenyl)-N,N'-diphenyl-(1,1'-biphenyl)-4,4"-diamine) in 113 grams of methylene chloride. The coating solution contains 15.04 weight percent solid (MAKROLON™ and m-TBD) based on MAKROLON™, m-TBD and methylene chloride.

The above charge transport solution was coated on an imaging member web. This imaging member web comprises a polyethylene naphthalate (PEN) based substrate having a thickness of 88.9 micrometers with 400–600 Angstrom units thick of a gamma aminopropylthiethoxysilane blocking layer, followed by 350–450 Angstrom units thick of 49,000 polyester adhesive layer, and approximately 0.4 micrometer of a hydroxygallium phthalocyanine charge generator layer. A first coating of the above charge transport solution was applied using a 0.002 inch (0.005 centimeters) gap Bird applicator and the coating was air dried for about 5 minutes before oven drying for about 1 minute at 120° C. A second coating was applied over the first coating using the same bar and conditions as used for the first coating. The overall coating thickness is about 29 microns.

EXAMPLE II

Formulation with m-TBD/PCZ-800/Methylene Chloride

A coating solution was prepared by mixing 10 grams of PCZ-800 (bisphenol-Z polycarbonate, commercially available from Mitsubushi Engineering-Plastics Corp.) and 10 grams of charge transport agent m-TBD (N,N'-bis(3-methylphenyl)-N,N'-diphenyl-(1,1'-biphenyl)-4,4"-diamine) in 113 grams of methylene chloride. The coating solution contains 15.04 wt % solid (PCZ-800 and m-TBD) based on PCZ-800, m-TBD and methylene chloride.

The above charge transport solution was coated on an imaging member web. This imaging member web comprises a polyethylene naphthalate (PEN) based substrate having a thickness of 88.9 micrometers with 400–600 Angstrom units thick of a gamma aminopropylthiethoxysilane blocking layer, followed by 350–450 Angstrom units thick of 49,000 polyester adhesive layer, and approximately 0.4 micrometer of a hydroxygallium phthalocyanine charge generator layer. A first coating of the above charge transport solution was applied using a 0.002 inch (0.005 centimeters) gap Bird applicator and the coating was air dried for about 5 minutes before oven drying for about 1 minute at 120° C. A second coating was applied over the first coating using the same bar and conditions as used for the first coating. The overall coating thickness is about 29 microns.

EXAMPLE III

Comparison of Examples I and II

The coatings of Examples I and II were viewed under a Nikon Optiphot microscope at 200 or 400× magnification for m-TBD crystallization.

Before Drying at 140° C.

Both coatings of Examples I and II showed no m-TBD crystallization.

After Drying at 140° C.

Both coatings of Examples I and II were dried at 140° C. for 30 minutes to drive off the residual solvent. The coating of Example I (MAKROLON) showed a significant amount of m-TBD crystallization. The crystallization could be observed, even without the use of the microscope. In contrast, a significant difference was observed for the coating of Example II (PCZ-800). Very little, if any, m-TBD crystallization was observed under the microscope.

Other modifications of the present invention will or may occur to those of ordinary skill in the art subsequent to a review of the present application. These modification variations and equivalents, including substantial equivalents, similar equivalents, and the like thereof are intended to be included within the spirit of the invention scope of the claims.

What is claimed is:

1. An imaging member comprising:

a substrate;

a charge generating layer; and a charge transport layer comprising charge transport molecules and a binder of poly (4,4'-diphenyl-1,1'-cyclohexane carbonate and wherein the ratio of poly (4,4'-diphenyl-1,1'-cyclohexane carbonate to charge transport molecules is from about 40 to about 60 weight percent poly(4,4'-diphenyl-1,1'-cyclohexane carbonate and from about 60 to about 40 weight percent charge transport molecules.

2. An imaging member according to claim 1 wherein the ratio of poly (4,4'-diphenyl-1,1'-cyclohexane carbonate to charge transport molecules is from about 50 weight percent poly (4,4'-diphenyl-1,1'-cyclohexane carbonate to about 50 weight percent transport molecules.

3. An imaging member comprising:

a substrate; and a single charge generating and charge transport layer comprising a binder, charge generating molecules and charge transport molecules, wherein the binder eliminates or minimizes crystallization of the charge transport molecules and wherein there is further included in said layer a second binder of an inactive polymeric film forming component selected from the group consisting of polyesters, polyarylates, polyacrylates, polyethers, and polysulfones.

4. An imaging member according to claim 1, wherein the binder has a molecular weight that ranges from about 20,000 to about 280,000.

5. An imaging member according to claim 3, wherein the binder has a molecular weight that ranges from about 20,000 to about 280,000.

6. An imaging member according to claim 2, wherein the poly (4,4'-diphenyl-1,1'-cyclohexane carbonate is selected from the group consisting of a poly (4,4'-diphenyl-1,1'-cyclohexane carbonate-800, with a weight average molecular weight of 80,000, poly(4,4'-diphenyl-1,1'-cyclohexane carbonate-500, with a weight average molecular weight of 51,000, and poly (4,4'-diphenyl-1,1'-cyclohexane carbonate-400, with a weight average molecular weight of 40,000 and mixtures thereof.

7. An imaging member according to claim 6, wherein the poly (4,4'-diphenyl-1,1'-cyclohexane carbonate is poly (4,4'-diphenyl-1,1'-cyclohexane carbonate-800, with a weight average molecular weight of 80,000.

8. An imaging member according to claim 6, wherein the poly (4,4'-diphenyl-1,1'-cyclohexane carbonate is the poly (4,4'-diphenyl-1,1-cyclohexane carbonate-500, with a weight average molecular weight of 51,000.

9. An imaging member according to claim 3, wherein the poly (4,4'-diphenyl-1,1'-cyclohexane carbonate is poly (4,4'-diphenyl-1,1'-cyclohexane carbonate-400, with a weight average molecular weight of 40,000.

10. An imaging member according to claim 3, wherein the charge transport molecules are selected from the group consisting of diamines, aromatic amines, pyrazolines, substituted fluorenes, oxadiazoles, hydrazones, carbazole phenyl hydrazones, tri-substituted methanes and mixtures thereof.

11. An imaging member according to claim 10, wherein the charge transport molecules are selected from the group consisting of N,N'-diphenyl-N,N'-bis(alkylphenyl)[1,1'-biphenyl]-4,4'-diamine, wherein the alkyl contains from about 1 to 20 carbons; N,N,N',N'-tetraphenyl-[2,2'-dimethyl-1,1'-biphenyl]-4,4'-diamine; N,N,N',N'-tetra(4-methylphenyl)-[2,2'-dimethyl-1,1'-biphenyl]-4,4'-diamine; N,N'-diphenyl-N,N'-bis(4-methylphenyl)[2,2'-dimethyl-1,1'-biphenyl]-4,4'-diamine; N,N'-diphenyl-N,N'-bis(2-methylphenyl)-[2,2'-dimethyl-1,1'-biphenyl]-4,4'-diamine; N,N'-diphenyl-N,N'-bis(3-methylphenyl)-[2,2'-dimethyl-1,1'-biphenyl]-4,4'-diamine; N,N'-diphenyl-N,N'-bis(3-methylphenyl)-pyrenyl-1,6-diamine; N,N'-bis-(3-methoxyphenyl)-N,N'-diphenylbiphenyl-4,4-diamine; bis(4-diethylamine-2-methylphenyl)phenylmethane; 4'-4"-bis(diethylamino)-2',2"-dimethyttriphenylmethane; N,N'-diphenyl-N,N'-bis(3-chlorophenyl)-[1,1'-biphenyl]4,4'-diamine; N,N'-diphenyl-N,N'-bis(4-chlorophenyl)-[1,1'-biphenyl]4,4'-diamine, 1-[lepidyl-(2)]-3-(p-diethylaminophenyl)-5-(p-diethylaminophenyl) pyrazoline; 1-[quinolyl-(2)]-3-(p-diethylaminophenyl)-5-(p-diethylaminophenyl) pyrazoline; 1-[pyridyl-(2)]-3-(p-diethylaminostyryl)-5-(p-diethylaminophenyl) pyrazoline; 1-[6-methoxypyridyl-(2)]-3-(p-diethylaminostyryt)-5-(p-diethylaminophenyl) pyrazoline; 1-phenyl-3-[p-dimethylaminostyryi]-5-(p-dimethylaminostyryl) pyrazoline; 1-phenyl-3-[p-diethylaminostyryl]-5-(p-diethylaminostyryl) pyrazoline; 9-(4-'dimethylaminobenzylidene)fluorene; 9-(4'-methoxybenzylidene)fluorene; 9-(2'4'-dimethoxybenzylidene)fluorene; 2-nitro-9-benzylidene-fluorene; 2-nitro-9-(4'-diethylaminobenzylidene)fluorene; 2,5-bis(4-diethylaminophenyl)-1,3,4-oxadiazole; pyrazoline; imidazole; triazole; p-diethylaminobenzaldehyde-(diphenylhydrazone); o-ethoxy-p-diethylaminobenzaIdehyde-(diphenylhydrazone); o-methyl-p-diethylaminobenzaldehyde-(diphenylhydrazone); o-methyl-p-dimethylaminobenzaldehyde-(diphenylhydrazone); p-dipropylaminobenzaldehyde-(diphenylhydrazone); p-diethylaminobenzaidehyde-(benzylphenylhydrazone); p-dibutylaminobenzaldehyde-(diphenylhydrazone); p-dimethyleminobenzaldehyde-(diphenylhydrazone); 1-naphthalenecarbaldehyde 1-methyl-1-phenylhydrazone; 1-naphthalenecarbaldehyde 1,1-phenylhydrazone; 4-methoxynaphthlene-1-carbaldehyde 1-methyl-1-phenylhydrazone; 9-methylcarbazole-3-carbaldehyde-1,1-diphenylhydrazone; 9-ethylcarbazole-3-carbaldehyde-1-methyl-1-phenylhydrazone; 9-ethylcarbazole-3-carbaldehyde-1-ethyl-1-phenylhydrazone; 9-ethylcarbazole-3-carbaldehyde-1-ethyl-1-benzyl-1-phenylhydrazone; 9-ethylcarbazole-3-carbaldehyde-1,1-diphenylhydrazone; aikyl-bis(N,N-dialkylaminoaryl)methane; cycloalkyl-bis(N,N-dialkylaminoaryl)methane; cycloalkenyl-bis(N,N-dialkylaminoaryl)methane and mixtures thereof.

12. An imaging member according to claim 1, wherein the charge transport molecules are selected from the group consisting of diamines, aromatic amines, pyrazolines, substituted fluorenes, oxadiazoles, hydrazones, carbazole phenyl hydrazones, tri-substituted methanes and mixtures thereof.

13. An imaging member according to claim 1, wherein the charge transport layer comprises from about 35 percent to about 50 percent by weight of at least one charge transport material, and about 50 percent to about 65 percent by weight of the binder.

14. An Imaging member according to claim 3, wherein the charge transport layer comprises from about 45 percent to about 49 percent by weight of at least one charge transport material, about 47 percent to about 50 percent by weight of the binder, and from about 1 percent to about 5 percent by weight of said charge generating molecules.

15. An imaging member according to claim 10, wherein the charge transport molecules are a non-polymeric small molecule charge transport material, the non-polymeric small molecule charge transport material being N,N'-diphenyl-N, N'-bis(3-methylphenyl)-[1,1'-biphenyl]-4,4'-diamine.

16. An imaging member consisting essentially of:

a substrate;

a photogenerating layer; and a charge transport layer comprising charge transport molecules and a binder of poly (4,4'-diphenyl-1,1'-cyclohexane carbonate and wherein the ratio of poly (4,4'-diphenyl-1,1'-cyclohexane carbonate to charge transport molecules is from about 40 to about 60 weight percent poly(4,4'-diphenyl-1,1'cyclohexane carbonate and from about 60 to about 40 weight percent charge transport molecules.

17. A process for minimizing the crystallization of charge transport molecules contained in a photoconductive imaging member comprised of a substrate a photogenerating layer and a charge transport layer and wherein said process comprises adding to said transport layer a binder of (4,4'-diphenyl-1,1'-cyclohexane carbonate in an amount from about 40 to about 60 weight percent and wherein said charge transport layer comprises charge transport molecules present In an amount of from about 60 to about 40 weight percent.

* * * * *